US007117641B2

(12) United States Patent
Lee

(10) Patent No.: US 7,117,641 B2
(45) Date of Patent: Oct. 10, 2006

(54) DEVICE TO PREVENT INSECT INTRUSION THROUGH WINDOW WEEP HOLES

(76) Inventor: Michael Brian Lee, 1732 Glastonbury Cir., Roseville, CA (US) 95747

( * ) Notice: Subject to any disclaimer, the term of this patent is extended or adjusted under 35 U.S.C. 154(b) by 300 days.

(21) Appl. No.: 10/667,400

(22) Filed: Sep. 23, 2003

(65) Prior Publication Data

US 2004/0091513 A1 May 13, 2004

Related U.S. Application Data

(60) Provisional application No. 60/425,710, filed on Nov. 13, 2002.

(51) Int. Cl.
*E04B 1/34* (2006.01)
*E04G 11/04* (2006.01)
*E04H 15/20* (2006.01)

(52) U.S. Cl. ..... 52/2.14; 52/734.2

(58) Field of Classification Search ..... 52/2.14
See application file for complete search history.

(56) References Cited

U.S. PATENT DOCUMENTS 4,691,478 A * 9/1987 Lorg ..... 49/499.1
4,765,094 A * 8/1988 Gemmell ..... 49/475.1
5,072,952 A * 12/1991 Irrgeher et al. ..... 277/652
6,405,488 B1 * 6/2002 Brown ..... 49/406

* cited by examiner

*Primary Examiner*—Carl D. Friedman
*Assistant Examiner*—Tiara Robertson
(74) *Attorney, Agent, or Firm*—Robert Platt Bell

(57) ABSTRACT

A apparatus to prevent insect intrusion through window weep holes includes a long filled tube which may be placed in the open track of a window. The apparatus is most effective when the window is open. The apparatus seals the window track to prevent bugs from intruding into the interior of the building. Its size and length may vary depending on the size of the window. Its shape may vary based on the design and the materials it is made of or filled with.

20 Claims, 10 Drawing Sheets

Figure 7A
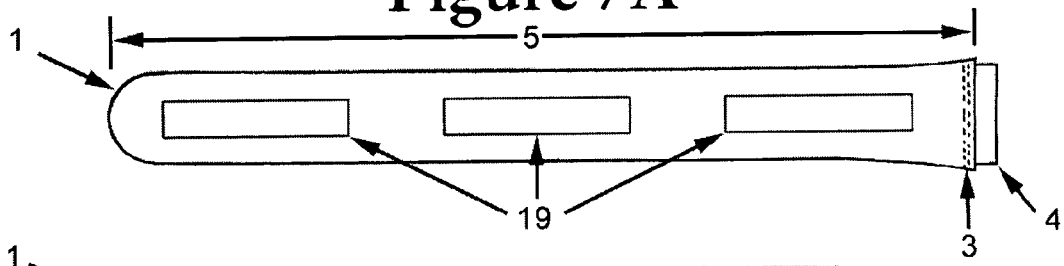
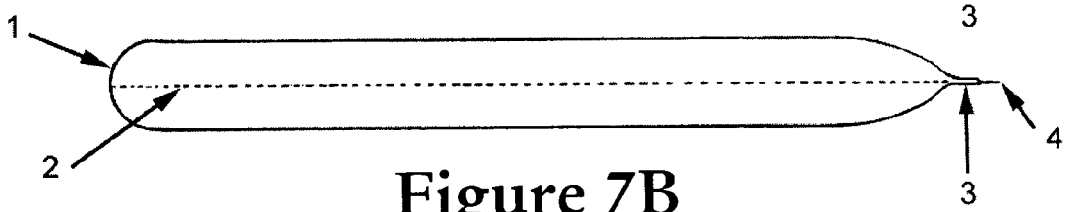
Figure 7B

DEVICE TO PREVENT INSECT INTRUSION THROUGH WINDOW WEEP HOLES

CROSS-REFERENCE TO RELATED APPLICATIONS

The present application claims priority from Provisional U.S. Patent Application No. 60/425,710 filed on Nov. 13, 2002, and incorporated herein by reference.

FIELD OF THE INVENTION

The present invention relates to the prevention of insect infiltration into the indoors through windows. More specifically, the present invention relates to an apparatus for preventing insect intrusion through window weep holes when a window is opened.

BACKGROUND OF THE INVENTION

Almost every building has windows and almost every building has windows which may be opened to ventilate the interior. Almost every ventable window also has a screen designed to keep insects and other pests from entering the interior of the building. Basic window design should accommodate an efficient method for directing water out of the window frame during a storm.

When a storm event or heavy rain occurs, water may penetrate the screen and wash down the glass into the window track. A facility should be provided in the track to prevent the water from backing up into the sill and into the interior of the building. While designs vary for meeting such needs, such designs generally end up providing an open hole into the interior of the building. The size of the hole and the design of how water is removed from the window track vary widely. For example, many windows manufactured today have so-called "weep" holes that are approximately ¼ inch high by two inches long.

FIG. 2 illustrates a common household sliding window with weep holes 11 provided at the bottom of the window track 12. The window sash (not shown) has been opened by sliding it out of view of FIG. 2. Note that although discussed here as a sliding window, the apparatus of the present invention may also be used with single and double-hung windows, casement windows, and other window types where weep holes 11 or the like may be present.

Window sill 13 is located at the bottom of the window while the vertical wall 7 surface is also illustrated. Window frames 6 include recesses to allow the window sash (not shown) to slide in a track 12 at the bottom edge of a sliding window. For single or double hung windows this track may also be present. Vertical track 8 securely holds the window when closed. Window screen 9 is illustrated as a tight mesh and may be held in place by the window screen frame 10.

Window weep hole 11 is illustrated and is not obstructed by the screen frame. There may be more than one weep hole per window. Weep hole designs vary and this illustration is intended to be an example of one such window manufacturer design. The present invention may be applied to other window designs having differently shaped weep holes without departing from the spirit and scope of the present invention. While such weep holes may efficiently drain water from the window track, they also provide a path of migration for intrusive insects and other pests.

Preventing insects and other pests from entering the interior of a building is a substantial business. Millions of dollars are spent every year in insect and pest eradication.

Insects in particular can carry various diseases, some of which can be life threatening for individuals that have weakened immune systems. Diseases such as West Nile Virus, for example, can be readily spread by the Asian Tiger Mosquito. Termites and other boring insects can cause thousands of dollars of damage to a building in a short period of time.

Insect intrusion can also lead to the unsightly display of dead insect bodies strewn about window sills and in light fixtures. Light fixtures in particular are difficult to clean, especially if they are mounted high above one's head.

In recent years there has also been heightened awareness of toxic mold. Poorly ventilated buildings often nurture such mold conditions. More people are heeding warnings about mold and choosing to ventilate their homes and businesses by opening windows more often.

However, when leaving windows open for long period of time, insects and the like may migrate into a home though the weep holes provided in the window frame for water drainage. Insects may even be able to pass by weep holes provided with hinged covers, flaps, or the like designed to prevent insect intrusion. Covering or plugging the weep holes (e.g. with duct tape, caulk, or the like) is not a viable option, as the window channel will tend to fill with water and possibly leak into the house, causing water damage.

Thus, it remains a requirement in the art to provide a means for preventing insect intrusion though weep holes or the like while still allowing water to drain from the weep holes.

SUMMARY OF THE INVENTION

The apparatus of the present invention, which may be marketed under the name ScreenBeanz!™ may serve to conceal unsightly and dirty window tracks, prevent drafts, insulate the window frame and prevent excessive dust intrusion.

In addition the device is also aesthetically appealing to multiple senses. Many people enjoy decorating their homes with objects which enhance the home's appeal and contribute to the occupant's sense of well-being.

The device of the present invention may best be thought of as a long filled tube that is placed in the open track of a window. The device is most effective when the window is open. The device seals the window track to prevent bugs from intruding into the interior of the building though weep holes and the like. Its size and length may vary depending on the size of the window. Its shape may vary based on the design and the materials it is made of or filled with.

The insect intrusion prevention device may be manufactured in a variety of lengths to accommodate various window sizes. There may be several standard lengths and an option for consumers to specify specific custom lengths and/or sizes. Most lengths may have the ability to accommodate window openings shorter than the length of the device by folding one end of the device onto itself.

The insect intrusion prevention device may also come in a variety of circumferences (or diameters) based on the specific design. Smaller windows may require smaller circumference devices while larger window openings may require larger circumferences. Additionally, the circumference may vary along the length of the device. In application, the apparatus of the present invention may have a diameter in the preferred embodiment of one to three inches.

The shape of the device may vary by design. Generally the device may be tubular in form but some may be wavy, crooked or have other variations.

There is no envisioned limit to the surface materials the apparatus of the present invention may be manufactured from. The device may likely be manufactured from cloth but may also be manufactured from the following materials, including, but not limited to, are: Tyvek™ (non-woven spun fabric), plastic, paper, rubber, metal or other material. A variety of surface materials may be used in the same device.

There is no envisioned limit to the materials the apparatus of the present invention may be filled with. Examples including, but not limited to, are: water, gel, PE (polyethylene) pellets, pinto beans, flax seed, cotton, polyester, potpourri or even shredded newspaper. A single device may use several fill materials.

The insect intrusion prevention device may have a variety of appeals beyond the functional aspects. Some of these are enhanced add-on characters that personalize the device. In an alternative embodiment, accommodation may be provided for the application of scented oils. Similarly, in another alternative embodiment, the apparatus may be provided with chemicals to ward off insects in an active manner. In other alternative embodiments, the consumer may fill the device with potpourri or use slip-covers to change the character of the device without buying a new one.

The present device is exceptionally easy to use. To use, simply lay the device in an open window track. If the window track is shorter than the device, simply re-distribute the fill material to one end, fold the empty end of the device onto itself and place the device in the open window track. The device is most effective when used with an open window.

BRIEF DESCRIPTION OF THE DRAWINGS

The accompanying drawings are included to provide further understanding of the invention, and are incorporated in and constitute a part of the present specification. The drawings illustrate embodiments of the invention and, together with the description, serve to explain the principles of the in invention. In the drawings.

FIG. 7A is a top view of an alternative embodiment of the present invention illustrating placement of mesh strips in the apparatus, FIG. 7B is a side of an alternative embodiment of the present invention illustrating placement of mesh strips in the apparatus.

DETAILED DESCRIPTION OF THE INVENTION

Figure 1A:
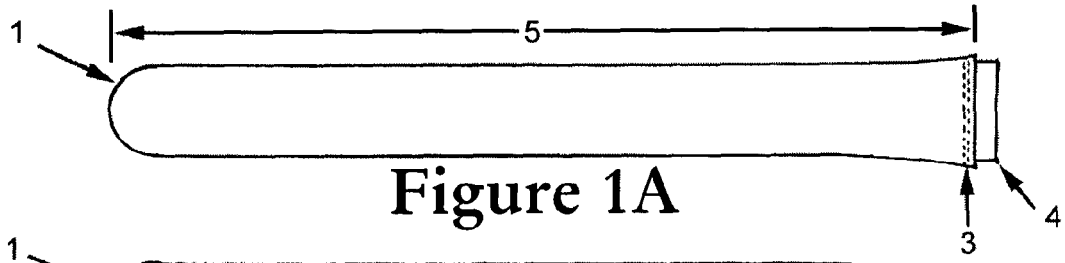
FIG. 1A is a top view of one embodiment of the present invention.
Figure 1B:
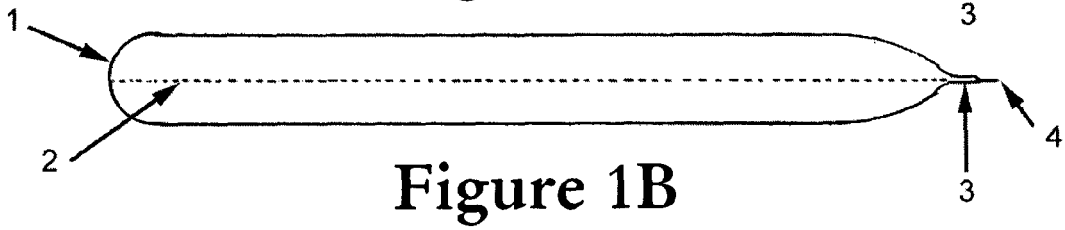
FIG. 1B is a side view of one embodiment of the present invention.

FIG. 1A is a top view of one embodiment of the apparatus 1 of the present invention illustrating the variable length 5. FIG. 1B is a side view of one embodiment of apparatus 1 of the present invention. Referring to FIGS. 1A and 1B, seam 2 is displayed along the length of the apparatus 1 and at the end 3 of the apparatus 1 where the contents are sewn in. Description tag 4 may be included and may contain information about the apparatus 1. Description tag 4 may include information about material origins and where to go for additional information (e.g., website link, 1-800 number, address, or the like) . The apparatus 1 of the present invention is shown as generally tubular along its entire length. However, as disclosed, it is not limited to being tubular and may vary in length.

Figure 2:
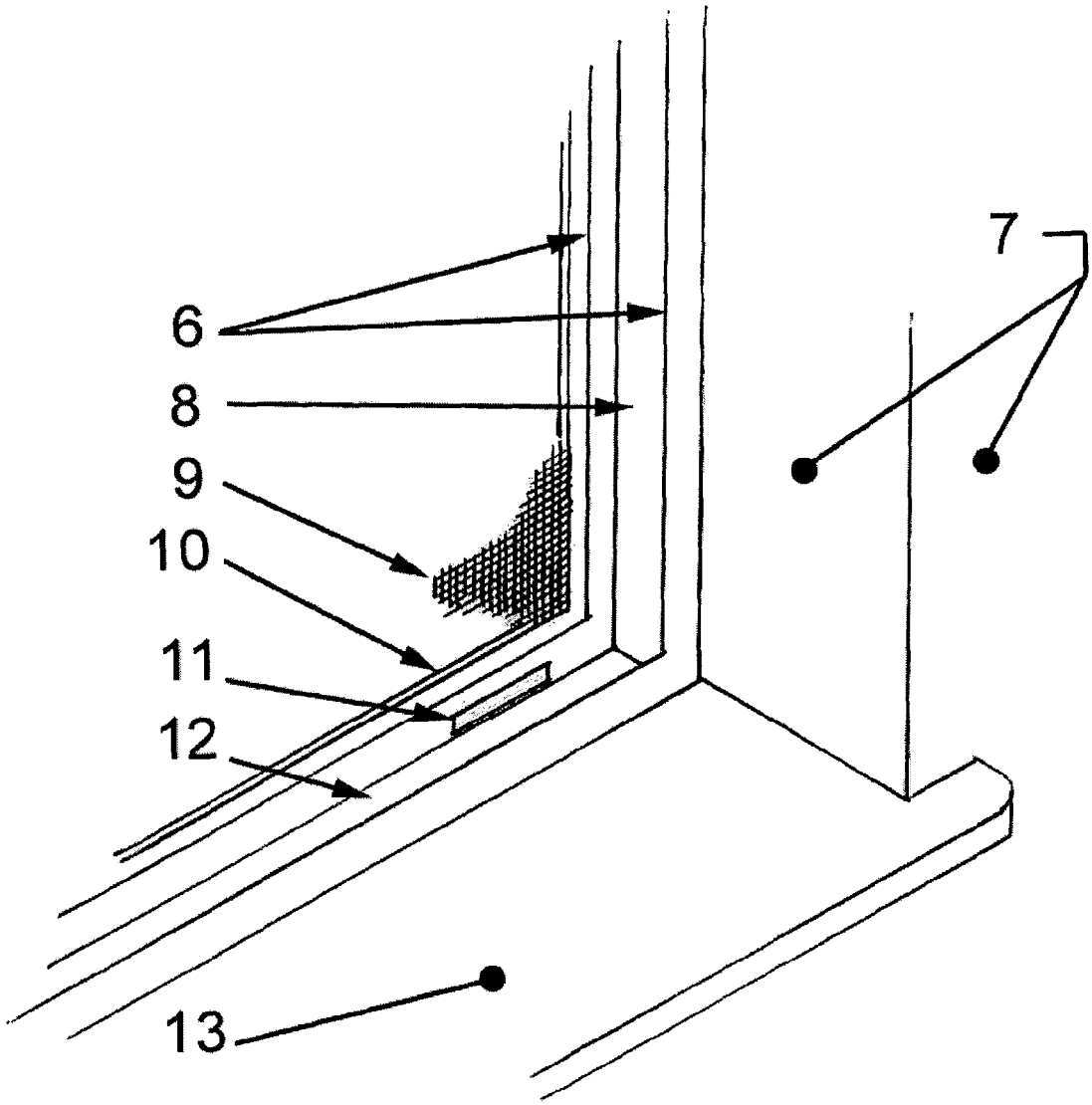
Figure 2 (Prior Art)
FIG. 2 is a perspective view of a Prior Art window, illustrating a standard window frame without the device present.
Figure 3:
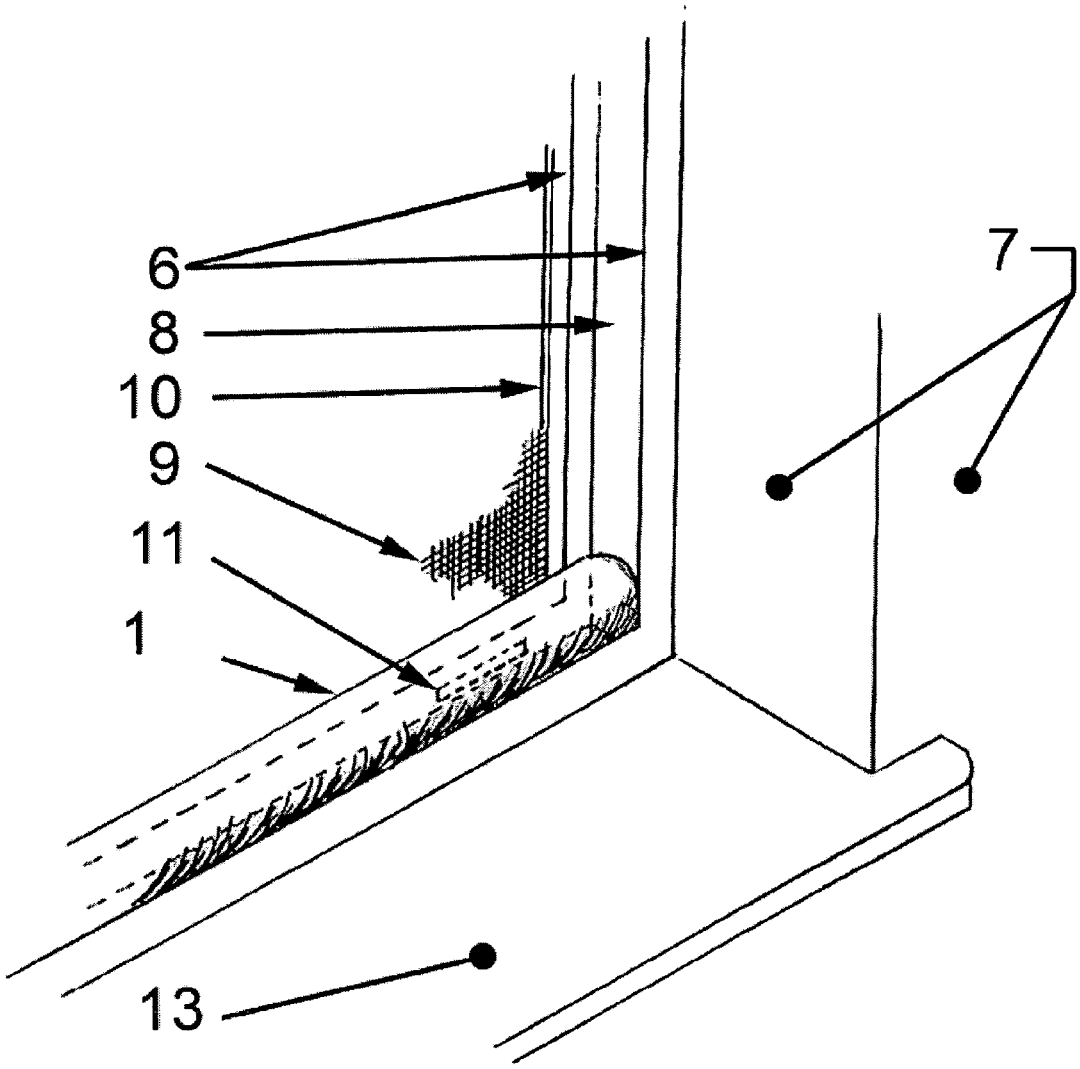
FIG. 3 is a perspective view of the window of FIG. 2, illustrating the standard window frame with the apparatus of the present invention in place.

FIG. 3 illustrates a window frame with the apparatus in place. As in Prior Art FIG. 2, the window is also illustrated here with the window open. As in FIG. 1 the window sill 13 is displayed at the bottom of FIG. 3 with the vertical walls 7 on the right hand side of the drawing. Window frame 6 accepts and secures a closed widow is illustrated with screen 9 and screen frame 10 fitted snugly to window frame 6. Vertical window track 8 continues horizontal along the bottom of FIG. 3 is dotted where hidden by the insect intrusion prevention apparatus 1. Window weep 11 hole is also illustrated as a dotted line for reference purposes.

As illustrated in FIG. 3, when apparatus 1 is inserted into the horizontal window track, weep hole(s) 11 are covered up by apparatus 1. In addition, the entire horizontal track is covered so as to provide an attractive appearance.

Figure 4:
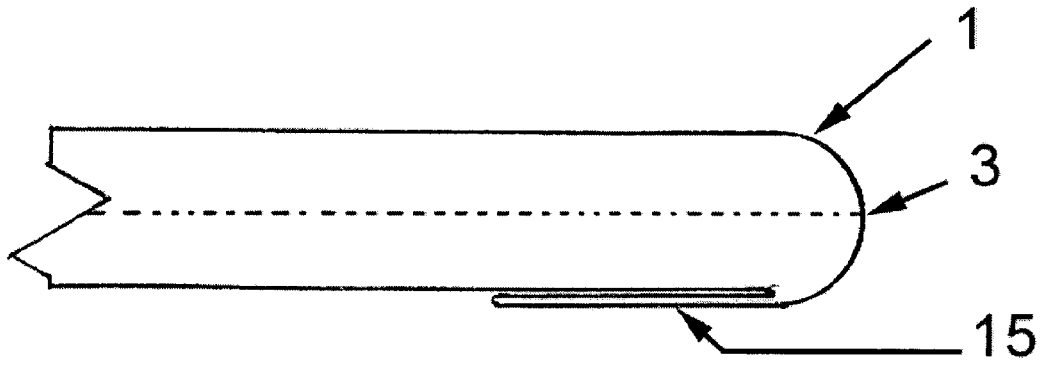
FIG. 4 is a side view of the apparatus of the present invention, illustrating the device with one end folded onto itself.

FIG. 4 illustrates the apparatus 1 with the one end folded onto itself 15. Sewing seam 3 is also displayed for reference purposes. If apparatus 1 is too long for a given window track, the user merely moves the stuffing material from one end of apparatus and folds the empty portion 15 underneath as illustrated in FIG. 4. In this manner, apparatus 1 provides an appearance of being custom fit to each window, even if the length of apparatus 1 is longer than necessary.

Figure 5A:
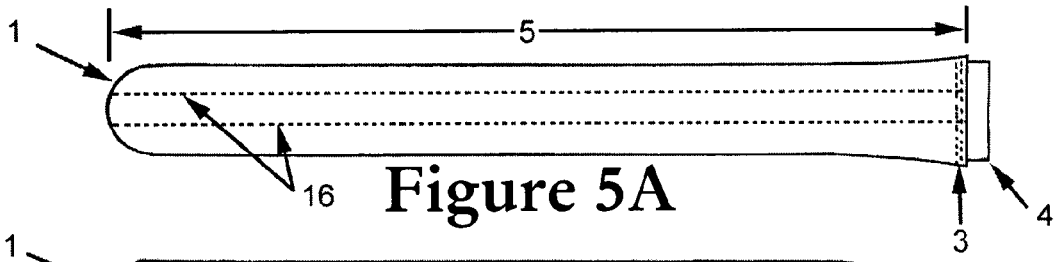
FIG. 5A is a top view of an alternative embodiment of the present invention, illustrating a design which allows the application of scented oils.
Figure 5B:
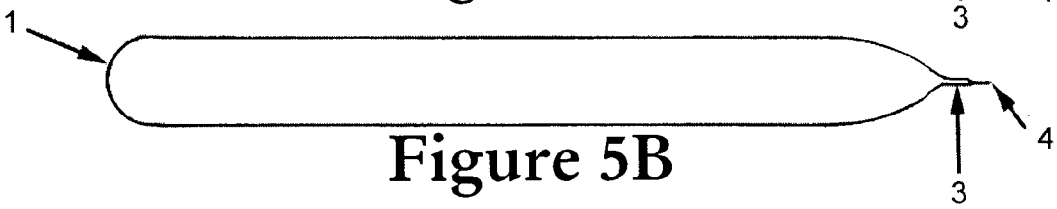
FIG. 5B is a side view of the alternative embodiment of FIG. 5A, illustrating a design which allows the application of scented oils.

FIG. 5A is a top view of an alternative embodiment of the present invention, illustrating a design which allows the application of scented oils. FIG. 5B is a side view of the alternative embodiment of FIG. 5A, illustrating a design which allows the application of scented oils. The embodiment of FIGS. 5A and 5B allows aromatic oils to be absorbed and slowly released when heated by the sun. The basic apparatus 1 is illustrated with the addition of two seams 16 provided down the entire length of apparatus 1. Seams 3 close apparatus 1 and the information tag 4 may remain unchanged from the embodiment of FIGS. 1A and 1B. Note that seams 16 do not appear in the side view of FIG. 5B, but are illustrated in the top view of FIG. 5A. As in the embodiment of FIGS. 1A and 1B, the length 5 of apparatus 1 may vary.

Figure 6:
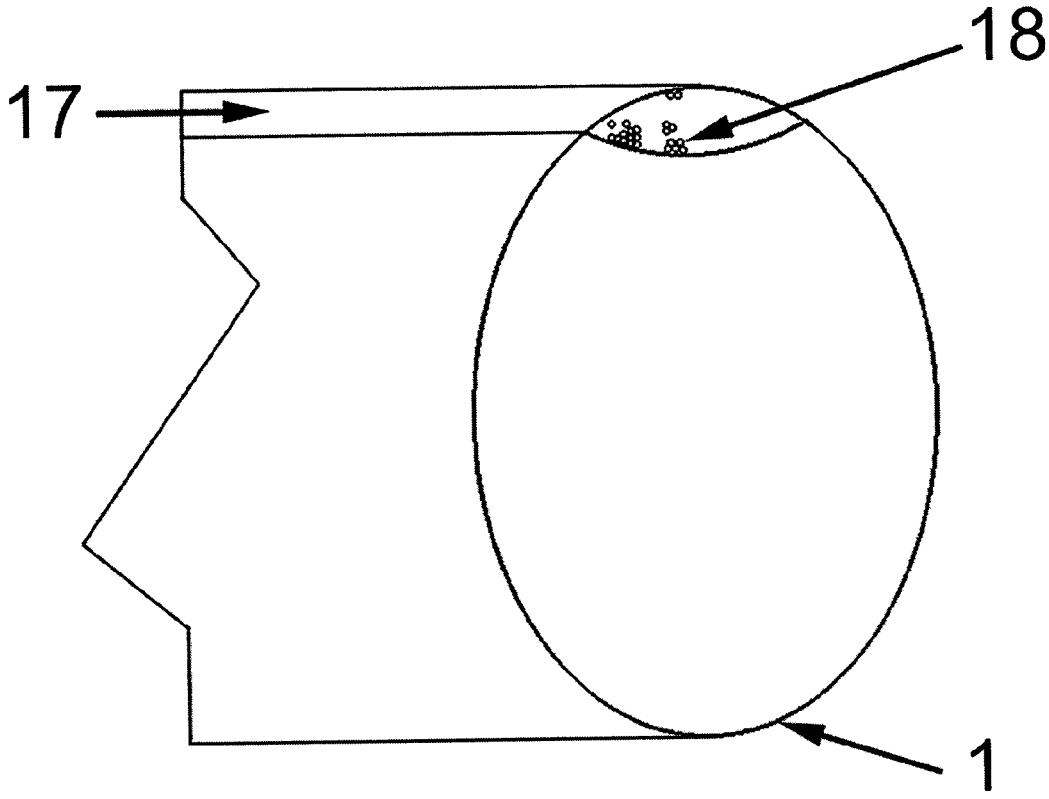
FIG. 6 is a cut-away close-up view of the scented oil design if FIGS. 5A and 5B.

FIG. 6 is a cut-away close-up illustrating the alternative embodiment of FIGS. 5A and 5B. A sewn-in absorbent strip 17 may be provided, as well as the absorbent foam material 18 which may absorb and hold excess oils. For illustration purposes, no fill material is shown. In use, a consumer may apply a scented oil or other liquid material to absorbent strip 17. A few drops may be all that is necessary, although a consumer may use more if desired. Once the apparatus 1 is placed in a window sill in the sun, the heat from the sun may release scents from the scented oil or other material in absorbent strip 17. Such scents may waft into the building providing a refreshing scent in a home or business.

FIG. 7A is a top view of an alternative embodiment of the present invention illustrating placement of mesh strips in the apparatus, FIG. 7B is a side of an alternative embodiment of the present invention illustrating placement of mesh strips in the apparatus, FIGS. 7A and 7B illustrate yet another alternative embodiment of the apparatus of the present invention. As in the previous embodiments, the length 5 of apparatus 1 may vary. In addition, end seams 3 information tag 4 may remain unchanged.

In FIG. 7A, the addition and placement of three mesh fabric sleeves 19 of fabric can be seen. In FIG. 7B side seam 2 is illustrated as in the basic apparatus design of FIG. 1B. Although three mesh fabric sleeves 19 are illustrated, other numbers of such mesh fabric sleeves may be used within the spirit and scope of the present invention.

Figure 8:
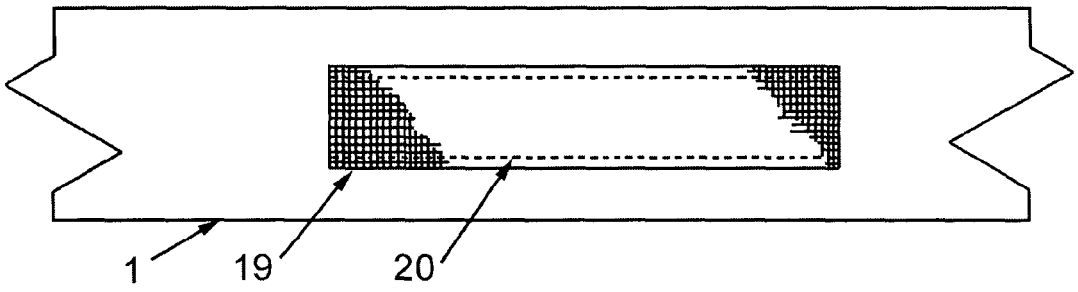
FIG. 8 is a close-up view of the mesh strips of the embodiment of FIGS. 7A and 7B, illustrating how the mesh strips are attached to the present invention.

FIG. 8 illustrates a close-up view of the apparatus 1 as described in FIGS. 7A and 7B. As illustrated in FIG. 8, mesh fabric sleeve 19 has been attached and sewn 20 to the outside of the apparatus 1. Mesh fabric sleeve 19 may accept and hold small cartridges which may contain elements to discourage pest intrusion (e.g., pest repellent chemicals such as DEET, or citronella scented cartridges, or the like).

Figure 9:
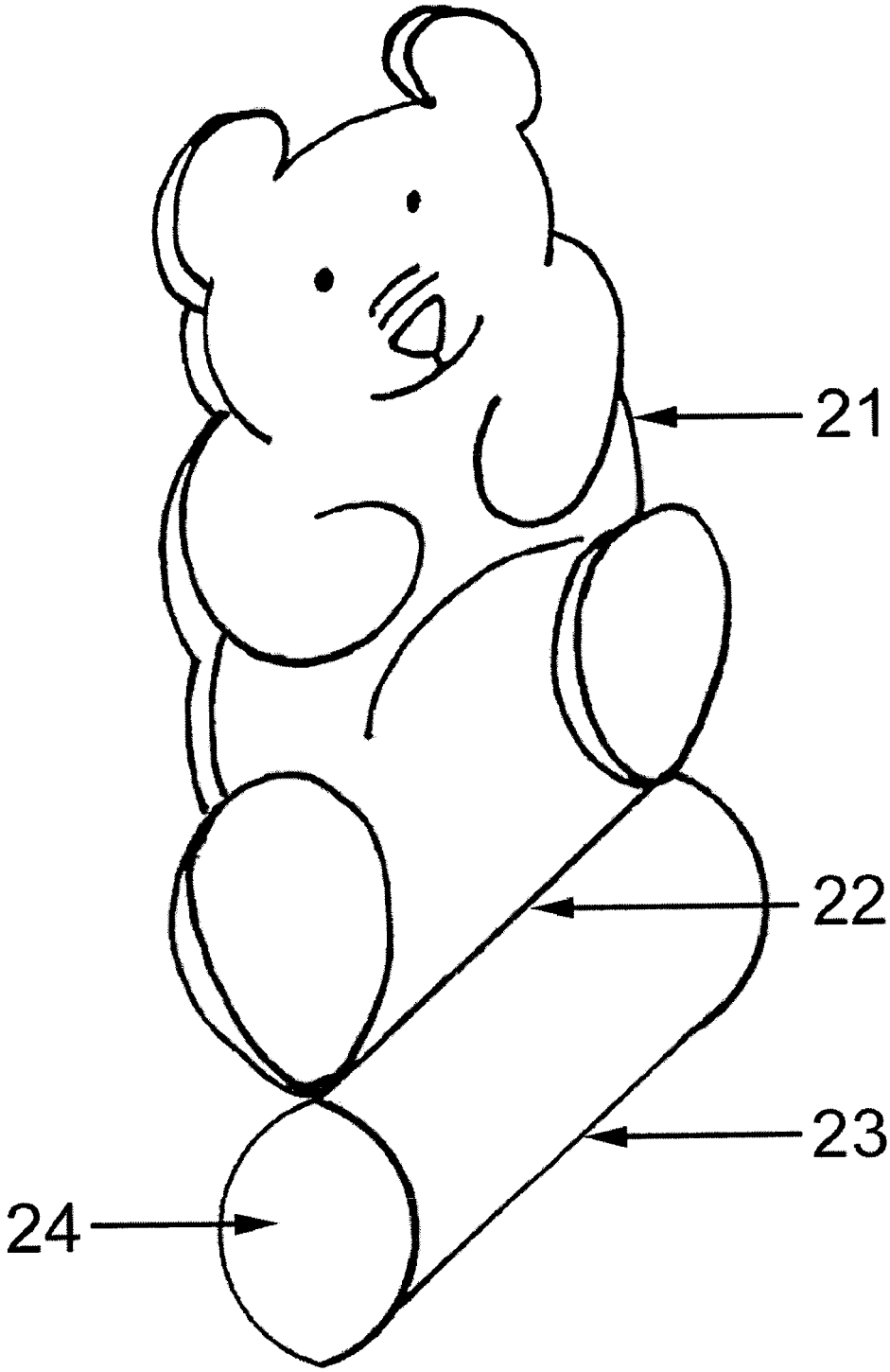
FIG. 9 is a perspective view illustrating an example of a caricature which may be attached to a sleeve in yet another alternative embodiment of the present invention.

FIG. 9 illustrates a caricature 21 attached to a sleeve 23 which may be used in conjunction with the apparatus 1 of the present invention. Caricature 21 may be attached to sleeve 23 at the line indicated by 22. The insect intrusion prevention apparatus 1 of the present invention may be slipped into the sleeve opening 24 as will be discussed below. Note that the actual caricature may vary, and may include one or more licensed characters such as cartoon characters, sports figures, or the like.

Figure 10:
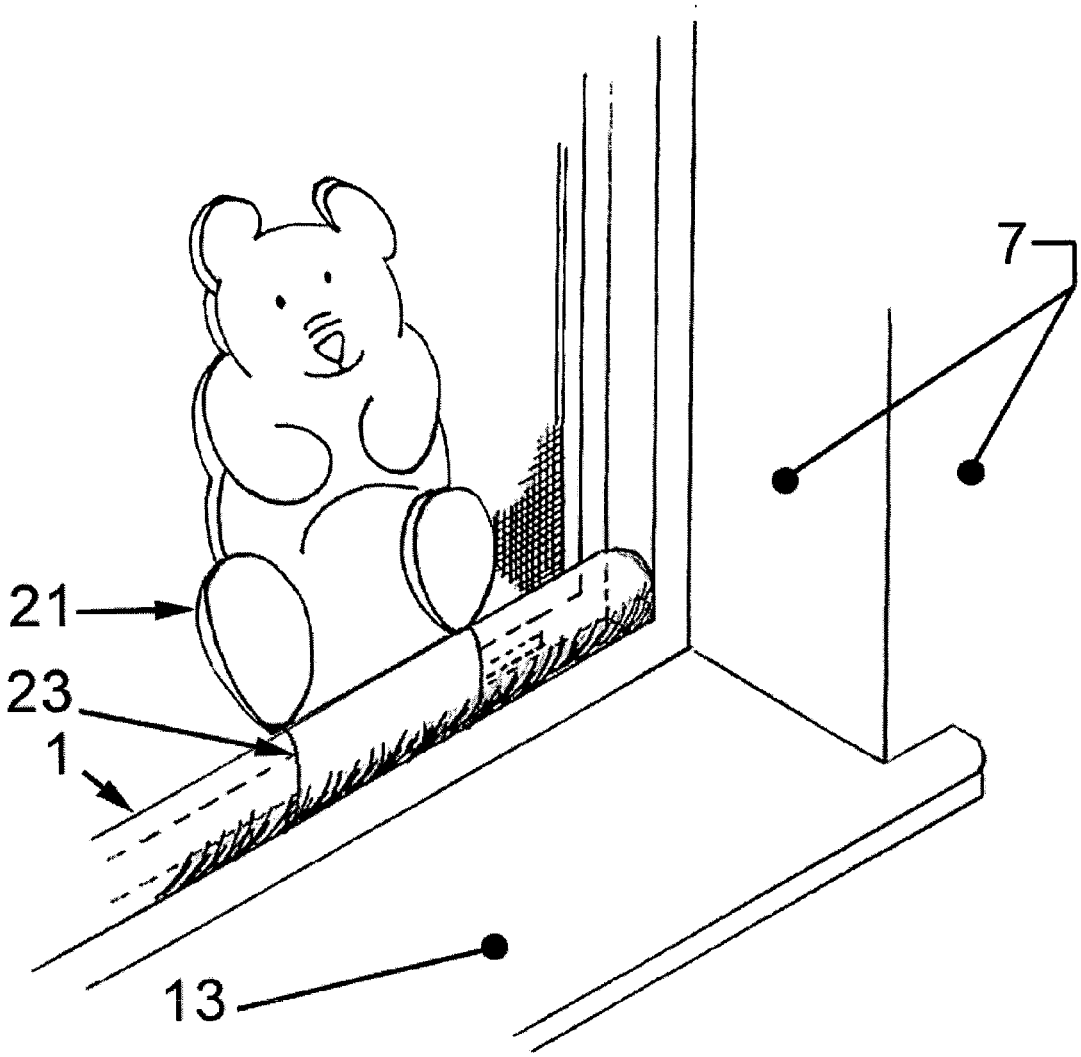
FIG. 10 is a perspective view of the window of FIG. 2, illustrating the standard window frame with the apparatus of the embodiment of FIG. 9 in place.

FIG. 10 illustrates caricature 21 with insect intrusion prevention apparatus 1 slipped through sleeve 23 described in FIG. 9. Caricature 21 rests against the screen when the window is open and against the window when the window is closed. Window sill 13 and vertical wall 7 are illustrated for reference purposes. When installed on the apparatus, Caricature 21 is visible to the consumer on the inside of the house, and also may be visible to passersby outside the home.

Thus, a consumer may use the apparatus of the present invention to display characters to decorate the home internally or externally. For example, for seasonal use, holiday characters (jack-o-lantern, Santa Clause, or the like) may be used to decorate a window. The weight of the tube portion of the present invention serves to secure the character in the window without the use of tape, screw, nails, or other fasteners.

In addition, the character, being displayed in the window track, will not interfere with window blind operation and the like. The character may be made of suitable materials including cardboard, plastic sheet or the like, and may be textured, embossed, or shaped (e.g., vacuum formed plastic) to provide a three-dimensional appearance if desired. The embodiment of FIGS. 9 and 10 may be useful for marketing to children and adolescents, as well as adults. Popular characters may be used to promote the apparatus of the present invention and also make the apparatus a collectable item for consumers.

As illustrated in the foregoing Figures, the apparatus of the present invention solves a problem in the Prior Art by providing a means of preventing insect intrusion though window weep holes, while still allowing water to drain through such holes. The apparatus may be made sufficiently water resistant such that it will not mildew or rot if left on the window sill during a rain storm. Alternately, the consumer may remove the apparatus from the window before closing the window or when it is going to rain.

While the preferred embodiment and various alternative embodiments of the invention have been disclosed and described in detail herein, it may be apparent to those skilled in the art that various changes in form and detail may be made therein without departing from the spirit and scope thereof.

I claim:

1. An apparatus to prevent pest intrusion through window track weep holes comprising:
   - a flexible tube having a predetermined diameter and a predetermined length;
   - a filling in the tube to fill and shape at least a portion of the tube to substantially conform to a shape of the window track; and
   - scenting means, attached to the tube, for receiving a scented oil, such that when the tube is placed in the window track, sunlight releases scent from the scented oil,
   - wherein the scenting means further comprises:
   - a sewn-in absorbent strip attached to a surface of the tube for absorbing a scented oil.

2. The apparatus to prevent pest intrusion through window track weep holes of claim 1, wherein the tube comprises at least one of cloth, non-woven spun fabric, plastic, paper, rubber, and metal.

3. The apparatus to prevent pest intrusion through window track weep holes of claim 1, wherein the filling includes at least one of water, gel, polyethylene pellets, pinto beans, flax seed, cotton, polyester, potpourri, and shredded newspaper.

4. The apparatus to prevent pest intrusion through window track weep holes of claim 1 wherein the scenting means further comprises:
   - an absorbent foam material provided beneath the sewn-in absorbent strip to absorb and hold excess scented oil.

5. The apparatus to prevent pest intrusion through window track weep holes of claim 1 wherein the fill material further includes insect repellant chemicals to ward off insects in an active manner.

6. The apparatus to prevent pest intrusion through window track weep holes of claim 1, wherein the tube is provided with a reclosable opening to allow a consumer to put potpourri into the tube such that a potpourri scent is released when the tube is placed in a window track.

7. The apparatus to prevent pest intrusion through window track weep holes of claim 1, wherein the tube is sufficiently flexible to be folded back onto itself, and the filler is sufficiently pliant to allow it to be moved within the tube such that if the window track is shorter than tube the filler may be re-distributed to one end of the tube and an empty end of the tube folded onto itself and placed underneath the tube in the open window track.

8. An apparatus to prevent pest intrusion through window track weep holes, comprising:
   - a flexible tube having a predetermined diameter and a predetermined length;

a filling in the tube to fill and shape at least a portion of the tube to substantially conform to a shape of the window track; and at least one interchangeable slip-cover which may be slid over the tube to change the aesthetic character of the apparatus, wherein the filled tube placed in the window track seals the window track weep holes to prevent pests from intruding into the interior of a building though the window track weep holes.

9. An apparatus to prevent pest intrusion through window track weep holes, comprising:

a flexible tube having a predetermined diameter and a predetermined length;

a filling in the tube to fill and shape at least a portion of the tube to substantially conform to a shape of the window track; and an add-on character figure having a character figure portion representing a predetermined character, and tubular portion slidable over the tube such that when the add-on character figure is displayed in the window when the tube is placed in a window track, wherein the filled tube placed in the window track seals the window track weep holes to prevent pests from intruding into the interior of a building though the window track weep holes.

10. A method for preventing pest intrusion through window track weep holes, comprising the steps of:

providing an apparatus comprising a flexible tube having a predetermined diameter substantially the same as the window track and a predetermined length at least as long as the window track, filling the tube with a filling to fill and shape the tube to conform to a shape of the window track, and placing the filled tube that is placed in the window track to seal the window track weep holes to prevent pests from intruding into the interior of a building though the window track weep holes.

11. A method for preventing pest intrusion through window track weep holes comprising the steps of:

providing an apparatus comprising a flexible tube having a predetermined diameter substantially the same as the window track and a predetermined length at least as long as the window track, filling the tube with a filling to fill and shape at least a portion of the tube to substantially conform to a shape of the window track, placing the filled tube in the window track to seal the window track weep holes to prevent pests from intruding into the interior of a building though the window track weep holes, and placing a scented oil on a predetermined portion of the tube, such that when the tube is placed in the window track, sunlight releases scent from the scented oil.

12. The method for preventing pest intrusion through window track weep holes of claim 11, wherein the tube comprises at least one of cloth, non-woven spun fabric, plastic, paper, rubber, and metal.

13. The method for preventing pest intrusion through window track weep holes of claim 11, wherein the filling includes at least one of water, gel, polyethylene pellets, pinto beans, flax seed, cotton, polyester, potpourri, and shredded newspaper.

14. A method for preventing pest intrusion through window track weep holes of claim 11 wherein the step of placing a scented oil on a predetermined portion of the tube comprises the step of placing a scented oil on a sewn-in absorbent strip attached to a surface of the tube for absorbing the scented oil.

15. The method for preventing pest intrusion through window track weep holes of claim 11 wherein the step of placing a scented oil on a predetermined portion of the tube comprises the step of placing a scented oil on an absorbent foam material provided beneath the sewn-in absorbent strip to absorb and hold excess scented oil.

16. The method for preventing pest intrusion through window track weep holes of claim 11, further comprising the step of placing at least one interchangeable slip-cover over the tube to change the aesthetic character of the apparatus.

17. A method for preventing pest intrusion through window track weep holes comprising the steps of:

providing an apparatus comprising a flexible tube having a predetermined diameter substantially the same as the window track and a predetermined length at least as long as the window track, filling the tube with a filling to fill and shape at least a portion of the tube to substantially conform to a shape of the window track, and placing the filled tube that is placed in the window track to seal the window track weep holes to prevent pests from intruding into the interior of a building though the window track weep holes, wherein the filling further includes insect repellant chemicals to ward off insects in an active manner.

18. A method for preventing pest intrusion through window track weep holes comprising the steps of:

providing an apparatus comprising a flexible tube having a predetermined diameter substantially the same as the window track and a predetermined length at least as long as the window track, filling the tube with a filling to fill and shape at least a portion of the tube to substantially conform to a shape of the window track, placing the filled tube that is placed in the window track to seal the window track weep holes to prevent pests from intruding into the interior of a building though the window track weep holes, and placing potpourri into the tube such that a potpourri scent is released when the tube is placed in a window track.

19. The method for preventing pest intrusion through window track holes comprising the steps of:

providing an apparatus comprising a flexible tube having a predetermined diameter substantially the same as the window track and a predetermined length at least as long as the window track, filling the tube with a filling to fill and shape at least a portion of the tube to substantially conform to a shape of the window track, placing the filled tube that is placed in the window track to seal the window track weep holes to prevent pests from intruding into the interior of a building though the window track weep holes, and attaching an add-on character figure having a character figure portion representing a predetermined character, and tubular portion slidable over the tube such that the add-on character figure is displayed in the window when the tube is placed in a window track.

20. A method for preventing pest intrusion through window track weep holes comprising the steps of:

providing an apparatus comprising a flexible tube having a predetermined diameter substantially the same as the window track and a predetermined length at least as long as the window track, filling the tube with a filling to fill and shape at least a portion of the tube to substantially conform to a shape of the window track, placing the filled tube that is placed in the window track to seal the window track weep holes to prevent pests from intruding into the interior of a building though the window track weep holes, redistributing the filler may be to one end of the tube, folding an empty end of the tube folded onto itself, and placing the empty end of the tube underneath the tube in the open window track so that the tube, when folded provides an apparatus substantially the same length as the window track.

* * * * *